United States Patent [19]

Speitel

[11] Patent Number: 4,676,408

[45] Date of Patent: Jun. 30, 1987

[54] CASE IN TWO PORTIONS ASSEMBLED BY A LATCHING DEVICE, NOTABLY A REFILLABLE SPRAYER

[75] Inventor: Francois Speitel, Parigne L'Eveque, France

[73] Assignee: Teleplastics Industries S.A., Parigne L'Eveque, France

[21] Appl. No.: 743,651

[22] Filed: Jun. 11, 1985

[30] Foreign Application Priority Data

Jun. 15, 1984 [FR] France ..... 84 09404

[51] Int. Cl.[4] ..... B65D 83/14

[52] U.S. Cl. ..... 222/183

[58] Field of Search ..... 222/182, 130–131, 222/183, 321, 383

[56] References Cited

U.S. PATENT DOCUMENTS 3,080,989 3/1963 Ramsbotham ..... 222/183 X
3,157,317 11/1964 Ramsbotham ..... 222/183
3,198,399 8/1965 Sagarin ..... 222/183 X

FOREIGN PATENT DOCUMENTS 2460407 6/1976 Fed. Rep. of Germany .
2344340 10/1977 France .
2537093 6/1984 France .

*Primary Examiner*—Charles A. Marmor
*Attorney, Agent, or Firm*—Young & Thompson

[57] ABSTRACT

A case in two positions assembled by a latching device, particularly a refillable sprayer comprising two portions (1-5) assembled by a shape fit of non cylindrical skirts (8-9). The inner skirt (8) has in at least two opposite portions, angularly distant from the portions of the section having the largest spacing, studs (10) protruding inwardly or grooves, part (5) carrying the outer skirt (9) comprising a latch (6) rotatably mounted about its geometrical center and having two opposite wings (18) adapted, by being rotated with the assistance of a control knob (27) protruding above the upper surface (26) of that part (5) to be engaged underneath the studs (10) or inside the grooves.

4 Claims, 14 Drawing Figures

CASE IN TWO PORTIONS ASSEMBLED BY A LATCHING DEVICE, NOTABLY A REFILLABLE SPRAYER

FIELD OF INVENTION

The present invention relates more particularly to so-called refillable sprayers comprising an outer case or envelope presenting a good decorative appearance and which can be of high price, and an inner container, called "refill", in a material such as glass, metal or plastics which is of lower price and which can be discarded once the product contained therein is consumed. The outer envelope is usually made of two portions which can be separated in order to allow the insertion of the refill. One of the two portions forms the side wall and bottom or upper portion, and the other reversely the upper portion or cover, or the bottom.

STATE OF THE ART

The problem encountered in the manufacture of such refillable sprayers resides essentially in the assembly of the two portions of the outer envelope, said assembly having to provide a good connection between the two portions in order to avoid an accidental opening, thereby excluding simple friction fit assemblies. The assemblies most currently used are the so-called screw or bayonet assemblies. However, said assemblies are only usable when the assembly is between two circular or substantially circular sections. The screw assembly requires larger thicknesses since the threads have to be cut out from the thickness of the skirts fitting into each other, and requires outer protrusions on the two portions for allowing applying manually the screwing and unscrewing torque, whereby the latter can be very high in the event of dirt accumulation or difficult to apply with greasy or wet gripping surfaces. Said outer gripping surfaces influence the general appearance of the envelope. The bayonet assembly has the same disadvantages although allowing, if a slight clearance between the outer skirt and the inner skirt is accepted, a slight ovalization of the sections.

As soon as the section of the outer envelope deviates from the circular shape, the only known assembly to this day is a friction fit assembly.

Yet, for aesthetic or space requirement reasons, non circular shapes with square, polygonal, rectangular or oval section are frequently desired. The same problem occurs at present with all containers having the same arrangement as the case or envelope of refillable sprayers, such as small boxes which must be openable in order to provide access to the products contained therein.

SUMMARY OF INVENTION

According to the invention and to a first feature, this result is reached due to the fact that in an envelope in two portions assembled by a shape fit of non cylindrical skirts, the inner skirt has, in at least two opposite portions angularly distant from the portions of the section having the largest spacing, studs protruding inwardly or grooves, and the portion carrying the outer skirt comprises a latch rotatably mounted about its geometrical center and having two opposite wings adapted, when rotated with the assistance of a control knob projecting above the upper surface of said part, for engagement underneath said stud or inside said grooves.

Preferably, the latch includes abutments limiting its angle of rotation and its control knob has a non cylindrical section for improving the grip allowing exerting the latching or unlatching torque.

According to another feature applicable notably to atomizers or sprayers, the portion carrying the latch forms the envelope cover and the control knob is hollow and is formed with an axial passage for the passage of the spraying member.

According still to another feature, a compressible resilient member is mounted in the bottom of the envelope body and presses the refill against the cover in order to bring the latch wings to rest against the support surfaces of the studs or grooves.

According to still another feature, the engagement between the control knob and the cover support surface is accomplished by means of an eccentric surface so as to provide a resilient cam effect, the unlatching being effected with an extra compression of the resilient member.

BRIEF DESCRIPTION OF DRAWINGS

Other features of the invention will become more apparent from the reading of the detailed description of an embodiment of a refillable sprayer, the description being made with reference to the accompanying drawings wherein.

DETAILED DESCRIPTION OF INVENTION

Figure 1:
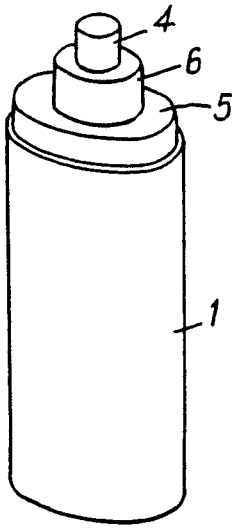
FIG. 1 is a general perspective view of a sprayer with an oval section, in its position of use.

In the drawings, reference 1 designates the body of the sprayer envelope, reference 2 the cap or cover fixed on the body for enclosing the spraying head, reference 3 designates the refill, reference 4 the pusher of the refill spraying pump, reference 5 the hood or cover of the envelope body, reference 6 the latch and reference 7 the resilient pad placed in the envelope bottom.

Body 1 of the sprayer envelope is made, as cap 2, of a material having a good surface appearance. They are of a cylindrical shape with an oval cross-section. Body 1 has in its upper portion a narrowed portion 8 for the fitting of hood 5 via skirt 9. Said portion 8 carries, at the two diametrically opposite points of the small axis of the cross-section, small shelves 10 protruding inwardly, the contour of the inner edge of said small shelves being oval.

For closing, cap 2 fits on a step 11 of hood skirt 9, and is maintained thereon in a removable manner through the interlocking of protrusions 12 provided on the vertical surface of said step inside corresponding notches formed near the edge of the cap inner surface.

The refill 3 is made of a material non sensitive to the product it contains and is most often glass. On its neck is crimped a plug 13 maintaining the pump and the pusher 4 of the spraying member of known type. The section of the refill is such that it can be engaged inside body 1 of the envelope. To this effect, its said faces have hollowed portions 14 for exposing shelves 10. The refill rests at the body bottom on resilient pad 7 which is made of a ring carrying resilient lugs 15 extending radially toward the center.

Hood 5 forms a cover which, as hereabove described, maintains refill 3 within body 1. It fits via its skirt 9 on the narrowed portion 8 of the body and, via step 11, inside the free edge of cap 2. It is formed in its upper surface with an orifice designated by general reference 16, said orifice being oblong in shape, with its larger dimension along the greater axis of the hood oval. The two ends of orifice 16 which are on the greater axis form notches 17 for the passage of the stud branches 18 of the latch which will be described hereafter. Starting from the opposite corners 19 of said notches, the orifice is defined by two arcs of circles 20 and 21 centered on the oval axis, the arc of circle 20 having a radius slightly larger than the arc of circle 21. Said portions 20–21 are connected to the other corner 22 of notches 17 by arcs of circles 23–24 having respectively the same radii as the arcs of circles 21 and 20. The connection region between the arcs of circles 20, 23 and 21, 24 forms an abutment 25 opposing the rotation of hoods. The upper surface 26 of the hood is upwardly ovoidal for providing a cam effect with the latch lower face.

Latch 6 comprises a cup-shaped body 27 of oval cross-section, with a skirt 28. From the two points at the ends of the smaller axis, skirt 28 is prolongated by branches 29 carrying the studs 18. The spacing between studs 18 and the length of branches 29 is such that when the latch is in engagement on the upper face of hood 5 and rotated such that the studs are in the direction of the hood small axis, studs 18 come into engagement underneath shelves 10 of envelope body 1.

From the cup bottom 27 depend two prongs in the shape of cylindrical sectors 30 and 31 centered on the latch axis and symmetrical with respect to the oval greater axis, the outer radii of said cylindrical sectors 30 and 31 corresponding to the radii of the arcs of circles 20 and 21 respectively and the angular development bring close to 90°. Each of the tongs carries, underneath the edge of skirt 28, a bead 32 which is distant from the surface containing the edge of skirt 28 by just over the thickness of the hood in order to allow the securement, by a snap-in engagement of said beads underneath the edge of the hood orifice 16, of said latch 6 on said hood 5. The surface of the latch edge is adapted to the ovoidal shape of the upper surface of the hood. The bottom of the latch is formed in its center with a circular orifice 33 for the passage of the pump pusher cap.

As explained hereabove, the mounting of latch 6 on hood 5 is accomplished by engaging branches 29 carrying the studs 18 in notches 17, the branch 30 with the shape of a cylindrical sector of larger radius being opposite the arc of circle 20 of orifice 16. The connection is the carried out by forcing latch 6 onto the hood in order to bring beads 32 underneath the hood surface. From then on, latch 6 can be rotated with respect to hood 5, the amplitude of the orientation being limited to 90° by the abutment of the edges of the cylindrical sector shaped prong 30 of larger radius against the connections 25.

Figure 2:
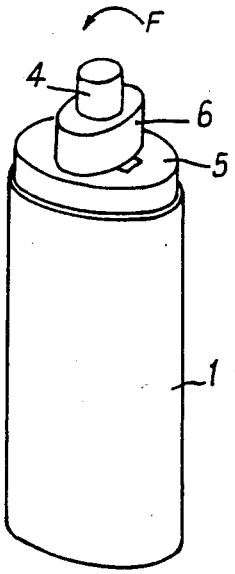
FIG. 2 is a view after a rotation of the latch for causing the unlatching.
Figure 3:
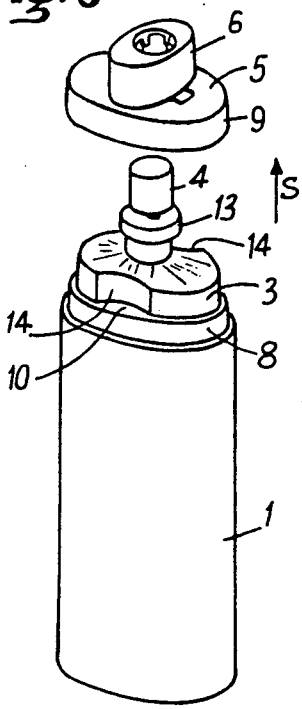
FIG. 3 is a view thereof with the cover removed.
Figure 4:
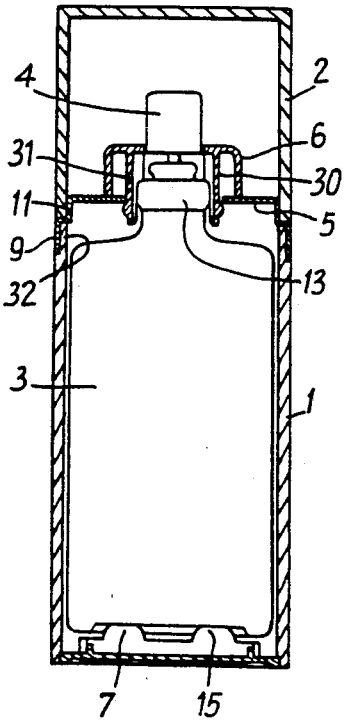
FIG. 4 is a sectional view thereof in the plane of the larger axis, the sprayer being provided with a cap.
Figure 5:
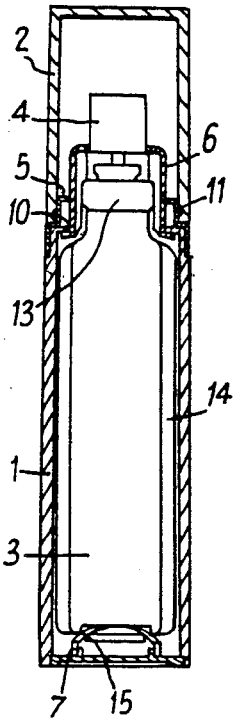
FIG. 5 is a sectional view thereof, in the plane of the smaller axis.
Figure 4A:
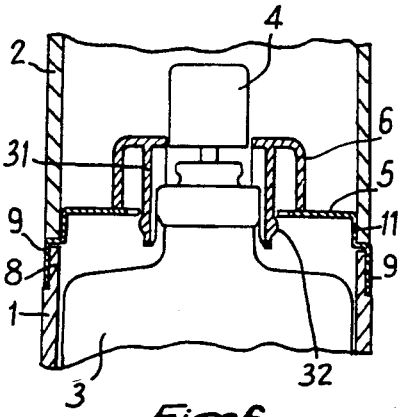
FIG. 4*a* is a detailed view of FIG. 4.
Figure 6:
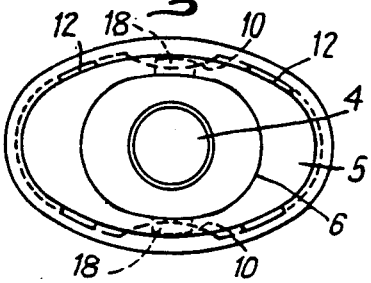
FIG. 6 is a top view thereof, with the cap removed.
Figure 7:
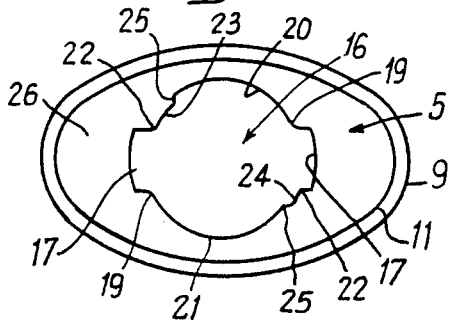
FIG. 7 is a detailed plan view of the hood.
Figure 8:
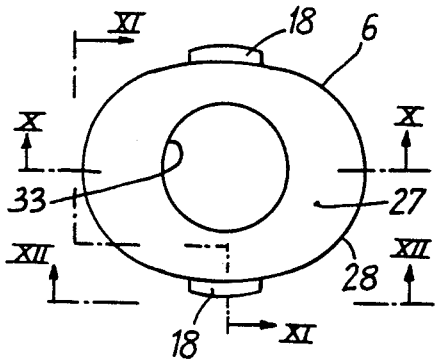
FIG. 8 is a plan view of the latch.
Figure 9:
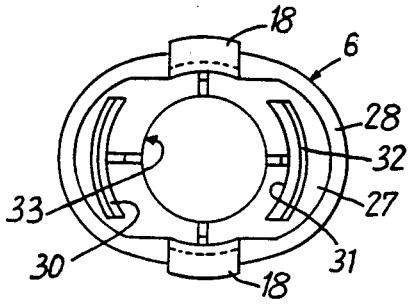
FIG. 9 is a bottom view thereof.
Figure 10:
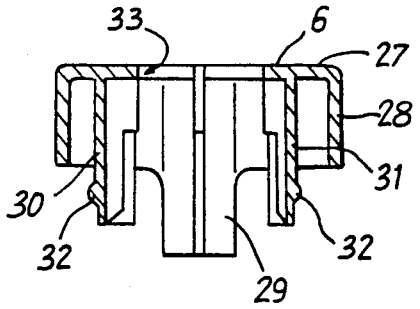
FIG. 10 is a sectional view thereof along line X—X of FIG. 8.
Figure 11:
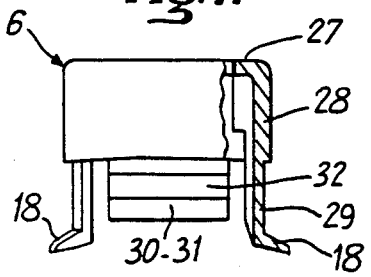
FIG. 11 is an elevation view with a partial cross-section along line XI—XI of FIG. 8.
Figure 12:
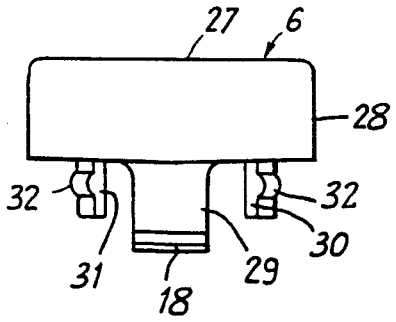
FIG. 12 is an elevation view along line XII—XII of FIG. 8.
Figure 5A:
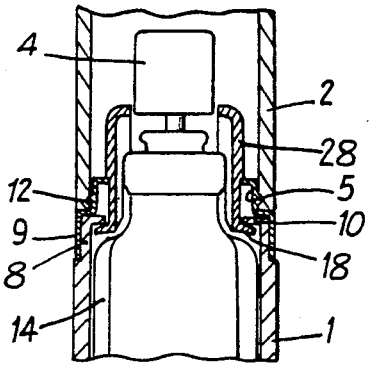
FIG. 5*a* is a detailed view of FIG. 5.

When the sprayer is in a closed state, hood 5 fits via its skirt 9 on the narrow edge 8 of the envelope body 1 and retains the refill 3 with a slight compression of resilient pad 7. Studs 18 are engaged underneath tongs 10, thereby blocking the hood in position on the inner envelope body 1. In order to refill the sprayer, viz. to change refill 3, the latch 6 is turned over a quarter of a turn in the direction of arrow F (FIG. 2) thereby disengaging studs 18 from tongs 10 and the assembly formed by hood 5 and latch 6 can then be extracted in the direction of arrow S (FIG. 3). Once the refill 3 has been replaced, the closing is carried out by reversed operations.

I claim:

1. A case in two portions assembled by a latching device, comprising a refillable sprayer comprising two portions assembled by a shape fit of inner and outer non cylindrical skirts, the inner skirt having in at least two opposite portions angularly spaced from the portions of the inner skirt having the greatest spacing, studs protruding inwardly, the outer skirt comprising a latch rotatably mounted about its geometrical center, said latch having two opposite wings adapted, when rotated with the assistance of a control knob protruding above the upper surface of said part forming the outer skirt, to engage underneath said studs, the outer skirt carrying the latch forming a cover of the case, the control knob being hollow and formed with an axial passage for an atomizing member of a refill, the fixation of the latch on the outer skirt comprising a snap-in engagement of beads carried by resilient lugs in the shape of cylindrical sectors protruding underneath the edge of the control knob in an oblong orifice of the outer skirt, said oblong orifice comprising circular sectors matching the periphery of the lugs and notches for the passage of the two opposite wings of the latch when said latch is in a non-latching position.

2. A case according to claim 1, wherein the latch includes abutments limiting its angle of rotation, said control knob having a non-circular shape.

3. A case according to claim 1, wherein a compressible resilient member is mounted in the bottom of the inner skirt and presses the refill against the outer skirt in order to bring the wings of the latch to bear against the studs of the inner skirt, the engagement between the control knob and support surface on the outer skirt occurring along a non-circular domed surface.

4. A case according to claim 2, wherein the resilient lugs in the shape of cylindrical sectors and the two corresponding circular sectors of the oblong hole have different radii, the two side edges of the lug of largest radius coming into abutment against shoulders forming the connections between the circular sectors in order to limit the rotation of the latch and to lock it in its latching and unlatching states.

* * * * *